United States Patent [19]

Heeszel

[11] Patent Number: 4,948,139

[45] Date of Patent: Aug. 14, 1990

[54] BINGO GAME BOX

[76] Inventor: Robert Heeszel, P.O. Box 432, Clearlake Oaks, Calif. 95423

[21] Appl. No.: 157,965

[22] Filed: Feb. 19, 1988

[51] Int. Cl.[5] ..... A45C 11/36; A63F 9/00; B65D 85/20

[52] U.S. Cl. ..... 273/148 A; 190/10; 190/32; 206/315.1; 248/461; 273/309

[58] Field of Search ..... 273/148 A, 309; 190/9, 190/10, 11, 13 H, 31, 32, 107, 115, 900, 901; 248/461; 206/315.1

[56] References Cited

U.S. PATENT DOCUMENTS

| | | | |
|---|---|---|---|
| 193,340 | 7/1877 | Lothrop | 190/11 UX |
| D. 204,277 | 4/1966 | Neal | D34/5 |
| 204,492 | 6/1878 | Kaplan | 190/10 UX |
| 458,155 | 8/1891 | Dieterich | 248/461 X |
| 2,913,137 | 11/1959 | Alatorre . | |
| 3,810,323 | 5/1974 | Lowe | 40/124 |
| 3,811,680 | 5/1974 | Benesch . | |
| 3,895,806 | 7/1975 | Burns . | |
| 4,372,630 | 2/1983 | Fuhri | 248/461 X |
| 4,453,714 | 6/1984 | Houser | 273/148 A |
| 4,502,658 | 3/1985 | Wirt et al. | 248/452 |
| 4,538,861 | 9/1985 | Hughes | 190/10 X |
| 4,544,158 | 10/1985 | Kilmonis | 273/150 |

*Primary Examiner*—Anton O. Oechsle
*Attorney, Agent, or Firm*—Bernhard Kreten

[57] ABSTRACT

A case particularly adapted to be utilized when playing Bingo. The case includes a lid which can be opened and expand to have an enlarged playing area substantially twice the surface area of the lid itself, and when thusly deployed, a marker storage area is exposed to allow access to Bingo markers. A pair of swinging doors is provided adjacent the front of the case which swing out and allows a plurality of different markers to be stored thereat whereby a plurality of Bingo games can be played simultaneously in a limited amount of space.

18 Claims, 2 Drawing Sheets

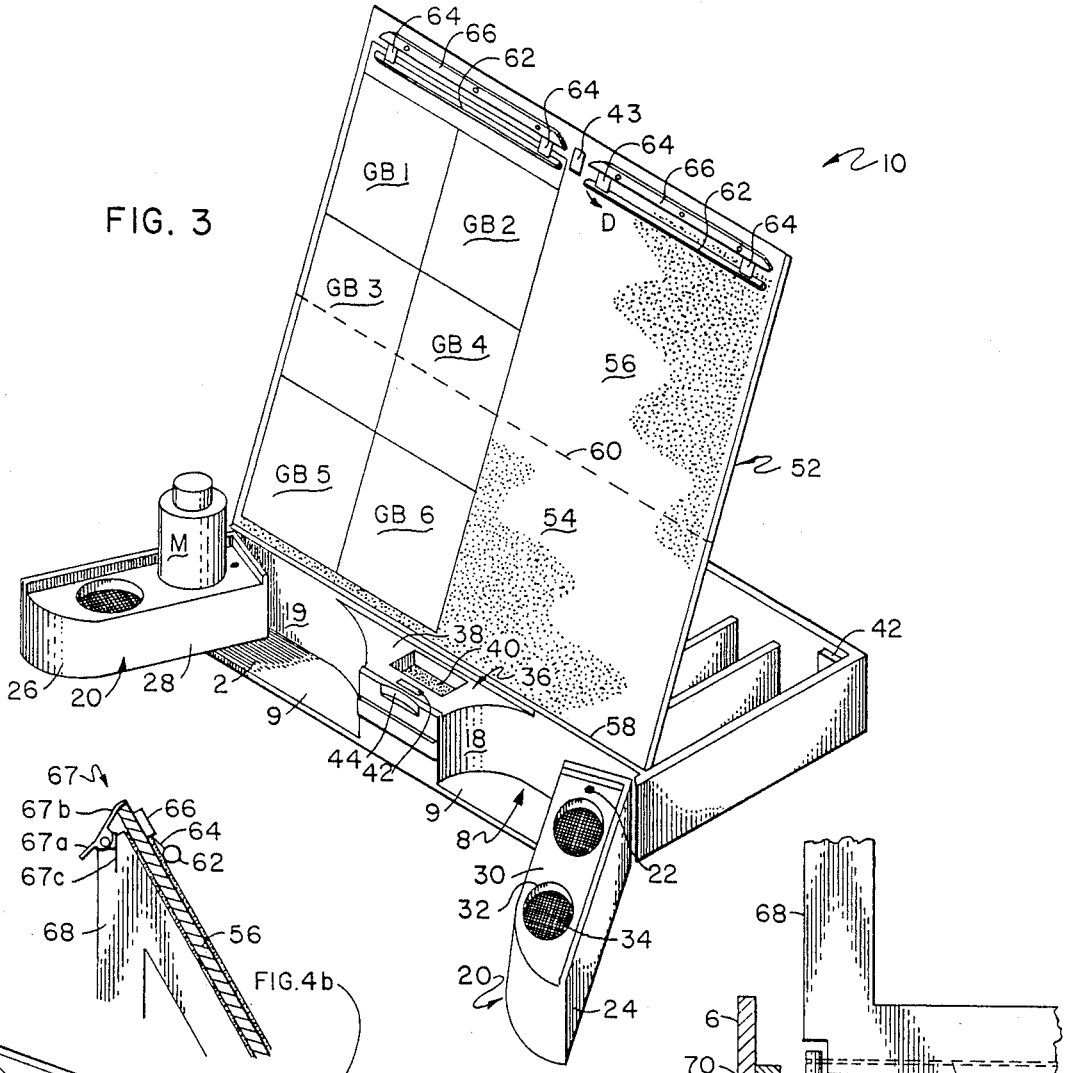
FIG. 3
FIG. 4b
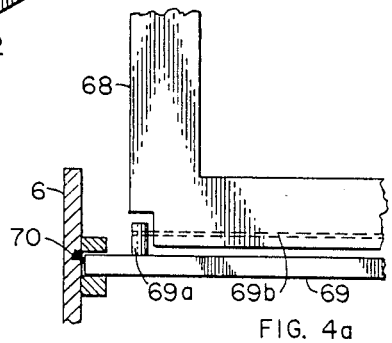
FIG. 4a
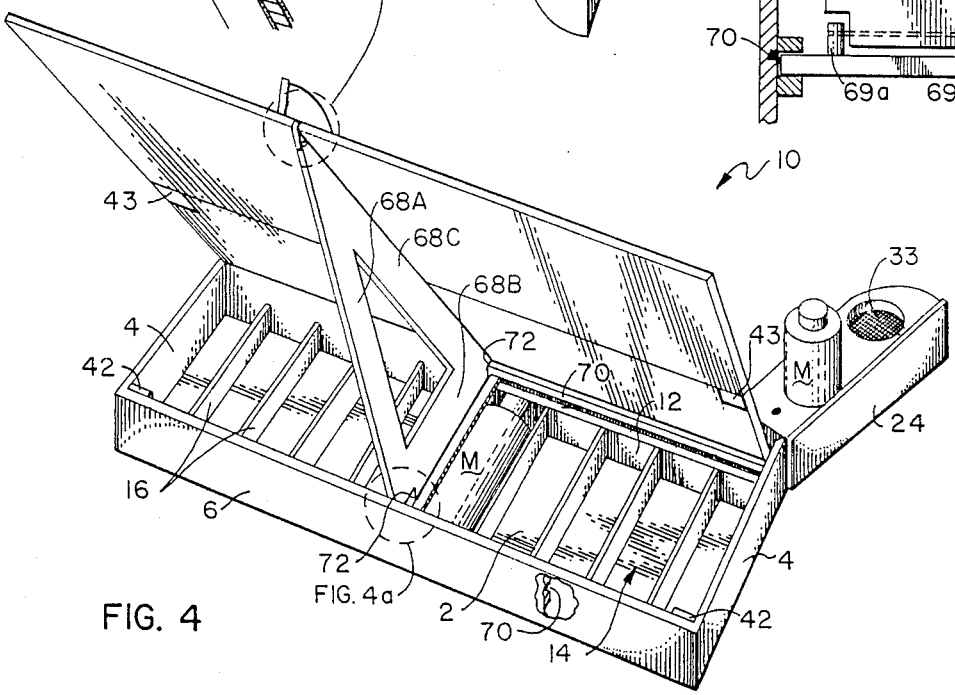
FIG. 4

BINGO GAME BOX

FIELD OF THE INVENTION

The following invention relates generally to a device which facilitates playing several distinct bingo game boards or sheets simultaneously.

BACKGROUND OF THE INVENTION

While Bingo has always been a popular activity, a renaissance of sorts has occured in the Bingo industry characterized in that a sophisticated and serious group of players engage in Bingo on a regular basis. In concert therewith, various improvements have occured in streamlining the game to the point now where the activity is relatively fast paced (due in part to the replacement of marker chips with ink markers) and the award of substantial prizes both in goods and in money.

Accordingly, it is not surprising that many players play several game sheets simultaneously. In fact, the playing sheets are sold with 3, 4 or 6 distinct game faces on each sheet. It is well within the scope of most people to play two sheets simultaneously.

With the advent of an increased number of games played simultaneously by persons, coupled with substantial increases in attendance at Bingo parlors, the amount of space each player is afforded has diminished somewhat over the years. Accordingly, a need exists to efficiently orchestrate the Bingo playing process to maximize the ability of a player to play several sheets simultaneously in minimal amount of playing space and time. It has been suggested that the quickened pace of the Bingo games along with substantial prizes have been instrumental in increasing the popularity of Bingo as a pass-time.

Not surprisingly, the renewed interest in Bingo has been accompanied by a spate of increased activity with respect to creation of new Bingo apparatus to facilitate playing the game. The following patents reflect the state of the art of which applicant is aware insofar as these patents appear germain to the instant invention:

| | | |
|---|---|---|
| 4,502,658 | Wirt, et al | March 5, 1985 |
| 4,453,714 | Houser | June 12, 1984 |
| 3,810,323 | Lowe | May 14, 1974 |
| 4,544,158 | Kilmonis | October 1, 1985 |
| 3,811,680 | Benesch | May 21, 1974 |
| 3,895,806 | Burns | July 22, 1975 |
| 2,913,137 | Alatorre | November 17, 1959 |
| D,204,277 | Neal | April 5, 1966 |

The patent to Houser teaches the use of a Bingo game support kit in which individual playing cards are rested on a support device, somewhat similar to pieces of tile on a "Scrabble" game holder. This device provides retention means for the markers currently in vogue used to mark the called numbers in a Bingo game.

The patent to Wirt, et al provides a Bingo sheet and marker retainer which more accurately reflects the format of Bingo cards as they are currently, most often available and collapses to provide compact storage. However, when folded as shown in FIG. 2 various components used in playing the game remain exposed and susceptible to dislodgement in transport.

The remaining citations show the state of the art further and are somewhat dated in that they fail to reflect the current trappings associated with modern Bingo playing.

SUMMARY OF THE INVENTION

The instant invention is distinguished over the known prior art in a plurality of ways. First, when the Bingo apparatus according to the present invention is in transport, its external dimension is slightly smaller than an attache case and has no exterior components which may be dislodged or lost that are integral with utilization with the game.

Second, all of the essential components, such as ink markers are integrally carried in the case. Moreover, once the Bingo box according to the present invention has been transformed into its operational, playing mode, the utensils, such as the ink markers are readily accessible for the player without impinging upon the playing area of other people, thereby providing an integrated compact playing unit.

Third, the inboard mechanism associated with assembling the Bingo box to an operational finished configuration is extremely simple and readily deployable by the player. Once assembled, certain areas associated with the Bingo box facilitate using different colored ink markers for different games, storage of change, glue sticks or other personal articles which the player may find useful and thereby enhance his enjoyment while playing Bingo.

OBJECTS OF THE INVENTION

Accordingly, a primary object of the present invention is to provide a new and useful apparatus to facilitate playing Bingo or other similar games.

A further object to this invention is to provide a device as characterized above which is compact and easily transportable and when opened up into a deployed, ready to play position occupies a minimal amount of space while providing access to all of the critical tools required to expeditiously engage in the game of Bingo particularly when several games are played simultaneously.

A further object of the present invention is to provide a device as characterized above which allows the personal belongings of the player to be conveniently stored, yet handy during the course of the game.

A further object of this invention contemplates providing a device as characterized above which allows the Bingo box to be collapsed in its container with a minimal amount of effort and time for convenience.

A further object of this invention is to provide a device as characterized above which is durable in construction, extremely safe to use and lends itself to mass production techniques.

Viewed from one vantage point, the device according to the instant invention facilitates the playing of plural games or the like, particularly Bingo in which a case is provided with an interior within which game playing implements are stored, the case including a lid for gaining access to the interior of the case and an instrumentality for increasing the surface area of the lid to form an enlarged playing surface along with a support extending above the case interior while still allowing access to the interior to facilitate playing the game.

Viewed from another vantage, the instant invention may be regarded as a box to facilitate simultaneous playing of plural Bingo games in which a knockdown playing surface formed from upper and lower playing surface portions are pivotally interconnected, and a brace is removeably attached to a rear portion of the playing surface to prop the surface up, and ink marker storage instrumentalities provided both forward and aft the playing surface allow ready access to the ink markers.

Viewed from yet a further vantage point, the instant invention has as an object the provision of an attache type case having a bottom wall, two side walls and a rear wall extending respectively up from side and rear edges of said bottom wall and a front wall including a vertical barrier outboard from which at least one swinging door is hinged, with the swinging door including a storage area, and a lid which occludes both an interior of the attache case and the swinging door storage area when the lid is closed.

These and other objects will be made manifest when considering the following detailed specification when taken in conjunCtion with the appended drawing figures.

BRIEF DESCRIPTION OF THE DRAWING FIGURES

FIG. 3 is a perspective view of the apparatus according to the present invention in its open, deployed configuration.

FIG. 4 is perspective view from the rear of that which is shown in FIG. 3.

FIG. 4A shows a detail of FIG. 4.

FIG. 4B shows a further detail.

BRIEF DESCRIPTION OF THE PREFERRED EMBODIMENT

Figure 2:
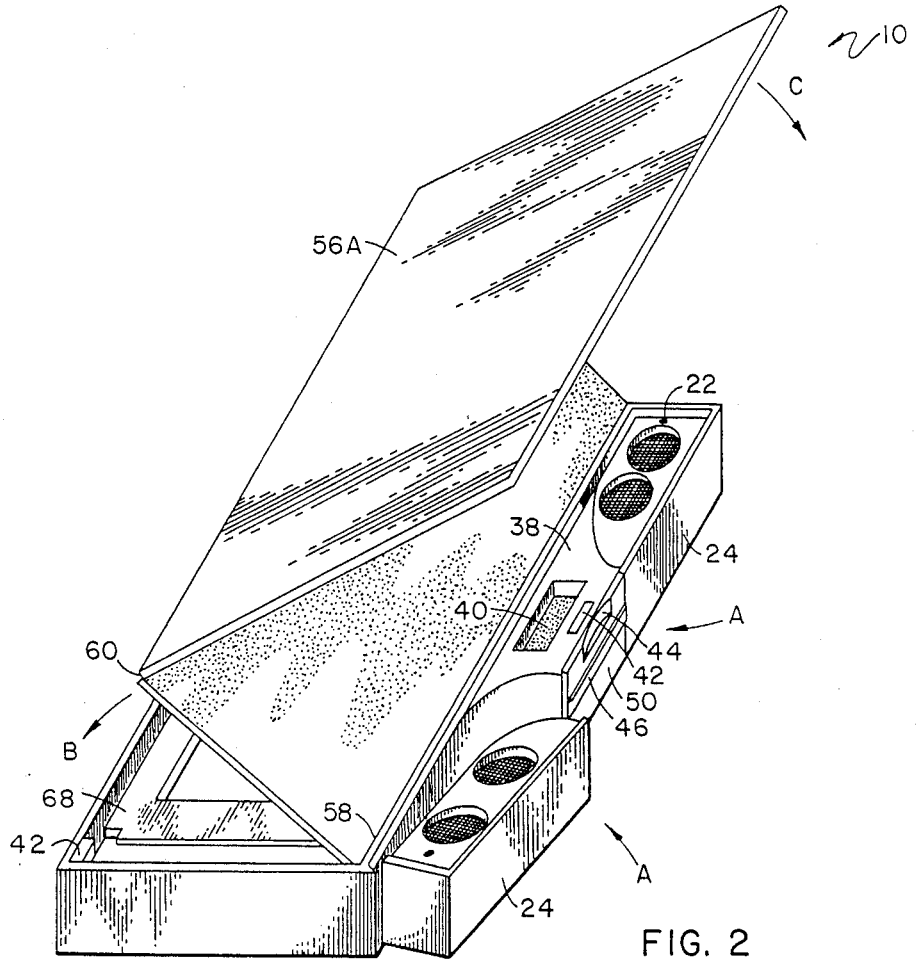
FIG. 2 is a perspective view of the apparatus according to the present invention in a stage of assembly.

Referring to the drawings now, wherein like reference numerals refer to like parts throughout the various drawing figures, reference numeral 10 is directed to the Bingo box case according to the present invention.

With particular reference to FIGS. 3 and 4, the case 10 is formed with a bottom wall 2, side walls 4 extending upwardly from side edges of the bottom wall, and a rear wall 6 extending up from a rear edge of the bottom wall 2. As shown in FIG. 3, the bottom wall 2 extends forwardly and includes a ledge 9 extending outwardly from the front of the case for purposes to be assigned.

Intermediate the ledge 9 and the remainder of the bottom wall 2, a vertically upstanding barrier 12 serving as a front wall is provided. Thus, the combination of the barrier 12, a portion of the bottom wall 2, side walls 4 and rear wall 6 collectively define a storage area 14 which has been partitioned by a plurality of partition walls 16 running parallel to the side walls 4 and extending between the rear wall 6 and the barrier 12. These smaller partitioned areas define recesses within which markers M are conveniently carried. These markers M are of known commercial manufacture and have particular utility when used in combination with the game board GB commonly distributed for Bingo. The marker serves as a highlighter to denote numbers which have already been called in the course of the game.

The ledge 9 in combination with a front wall 8 having an arcuate section 18 and a linear section 19 cooperate to form collectively a nesting are to receive swinging doors 20 as shown in FIG. 3. Each swinging door (two of which are in the preferred embodiment) is connected to the ledge 9 of the bottom wall 4 by means of dowels 22 allowing the doors to move along the direction of the arrows "A" shown in FIG. 2.

Figure 1:
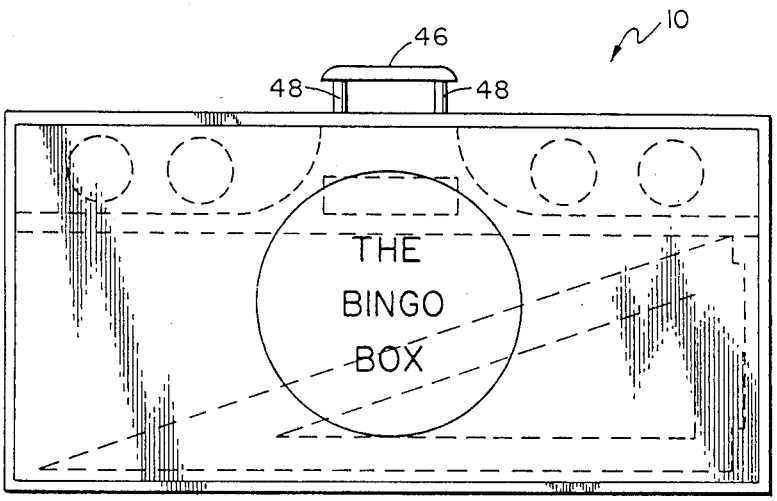
FIG. 1 is a top plan view of the apparatus according to the present invention showing certain internal components in dashed lines.

The swinging doors 20 include a front door face 24, an arcuate rear face 26 and a linear rear face 28. The linear and arcuate faces of the door are radiused to conform with the arcuate and linear sections of the front wall portion 18, 19 so that they are placed in substantially abutting tangential relationship when the doors 20 are moved to a closed position similar to that which is shown in FIG. 1 and partially in FIG. 2.

Each door has a top face 30 with openings 32 having a circumference complemental to the cross sectional diameter of the markers to allow the markers to be placed therewithin. To further this purpose, the doors are constructed hollow 33 and each door is provided with a bottom face 34 as an abutment or stop for the marker when it is placed within the opening 32.

The front wall 8 also includes a front wall storage area generally depicted by reference numeral 36. This storage area includes a horizontally disposed top shelf 38 within which a recess 40 is formed. Typically, during a Bingo game, refreshments are available to players and it is convenient to have change accessible to make purchases and the recess 0 finds particular utility in storing loose change and other miscellaneous articles.

The top shelf 38 also includes a magnetic latch 42 which cooperates with a magnetic catch 43 contained on a playing surface upper portion 56 for utilization in a manner to be defined shortly. Note the presence of depression 44 which allows a purchase area for one's fingers to gain access to an underside of the playing surface upper portion to dissociate it from the rest of the case when the device is to be deployed. Further magnets 43 on a lower playing surface portion 54 (rear side FIG. 4) fix to corners of the storage area 14 formed by side walls 4 and rear wall 6.

In addition, just below the depression 44 a handle 46 is provided (FIGS. 1 and 2) to facilitate transport of the case 10. The handle 46 includes two handle supports 48 configured as rods and extending transverse the plane of the handle and captured within the case along the front wall storage area 36. Thus, the handle can be moved from an extended position (FIG. 1) to a stored position (FIG. 2) for compactness when playing the game.

FIGS. 2 and 3 depict certain aspects of playing surface 52. As shown, the playing surface includes a lower portion 54 and an upper portion 56 which doubles as a lid as will be explained. The playing surface lower portion 54 is connected to a top edge of the front wall barrier 12 by means of a hinge 58 which allows articulation of the panel 54 along the direction of the arrows "B" shown in FIG. 2. In addition, an upper hinge 60 communicates between the lower and upper playing portions 54 and 56 to allow motion of the upper portion about the arrow "C" in FIG. 2. Thus, when the device is to be collapsed as suggested in FIG. 2, 56*a* evolves into an exposed lid surface which encloses not only the storage area 14, but also access to the swinging doors 20 and any contents that may be contained therewithin.

FIG. 3 shows the case in an open deployed position suitably configured for use with a Bingo type game. As the drawings show, clamps 62 are placed at top most edges of the upper portion 56 to hold sheets containing 3, 4 or 6 Bingo games each or cards containing 1 Bingo game each on the playing surface 52. Clamps 62 each have clamp arms 64 at distal extremities of each clamp, and these arms in turn communicate with a spring lever 66 so that motion of the spring lever in the direction of the arrow "D" will open or close the clamp thereby releasing the Bingo game sheet or board therefrom.

FIG. 4 reflects certain details with respect to keeping the playing surface 52 in an upwardly disposed configuration. Note that the playing surface 52 is inclinated with respect to both the horizontal and the vertical and in a preferred form of the invention has an included angle with respect to a top edge of one side wall of 60 degrees. As shown in FIG. 4, a triangular brace 68 holds the playing surface 52 in a deployed configuration. A tip of brace 68 includes a board lock 67 including a lever 67*a*, a lever arm 67*b* and a lever support 67*c* fixed to brace 68. The lever 67*a* is spring biased to retain the lever arm 67*b* against a top edge of the playing surface 56. The triangular brace 68 has a vertical leg 68*a*, a horizontal base 68*b* and a hypoteneuse 68*c* formed as a three bar linkage with a hollow center. Opposed extremities of the base 68*b* are provided with cutaways 72 of substantially rectangular configuration so that the brace 68 can be secured on a pair of spaced parallel "U" shaped tracks 70 disposed above top edges of the partitions 16 and fixed near to top edges of both the rear wall 6 and the front wall barier 12. Thus, the cutaways 72 nest upon a top and side surface of one of the tracks 70 with the triangular brace extending vertically upward with the hypoteneuse facing toward the front of the case so that the playing surface 52 rests thereon The brace 68 includes a guide 69 which runs between the two spaced tracks. The tracks 70 are substantially "U" shaped and the guide 69 fits in each "U". The guide 69 connects to the brace 68 by means of a wire 69*b* passing through the base of 68*b*, serving as a pivot. The wire 69*b* is supported on the guide 69 by two upstanding dowels 69*a*.

When the playing surface is to be stored, the triangular brace 68 is laid down on top of the partitions 16 and the playing surface 52 and its upper and lower portion 56–54 respectively are folded up along arrows B and C (as shown in FIG. 2) as well having the swinging doors 20 be placed as suggested by the arrows "A". The box then assumes the configuration in FIG. 1 for easy transport until the Bingo box is to be used another time. By having the playing surface upper portion 56 configured as shown, a marginal overhang of the upper portion will occlude access to the doors 20 and therefor allow contents therewithin to remain secure. Note the further magnets 42 and 43 fixing the lower playing surface 54 to the storage area 14.

Moreover, having thus described the invention, it should be apparent that numerous structural modifications and adaptations may be resorted to without departing from the scope and fair meaning of the claims as setforth herein below.

I claim:

1. An attache type case having a bottom wall, two side walls and a rear wall extending up from side and rear edges of said bottom wall respectively, and a front wall including a vertical barrier, at least one swinging door pivoted to said bottom wall, said swinging door including storage means, and lid means which occludes both an interior of said attache case and said swinging door storage means when said lid means is closed.

2. The attache case of claim 1 wherein said vertical front wall barrier includes a front face having a handle which nests within a complementally formed recess of said front face and a front wall portion including an arcuate and linear section complementally formed with said swinging door to allow said swinging door to nest thereagainst.

3. The case of claim 2 wherein two swinging doors are provided and said front wall portion has a second arcuate and linear wall portion to accomodate said second swinging door.

4. The case of claim 3 wherein each said swinging door includes a dowel attached to said case, and each said door has an arcuate rear face and linear portion, a top face of each said door provided with openings to allow storeage therewithin, and a bottom wall face of each said door to serve as an abutment for articles contained within the openings for storage in each said door.

5. The case of claim 4 wherein said lid means is formed from upper and lower said playing portions attached to said case by means of hinges and foldable one upon the other to provide a two-ply lid when in a stored configuration, and magnetic latch means on a playing surface upper portion adapted to lie in registry with a magnetic latch contained on a front wall top surface.

6. The case of claim 5 wherein said bottom wall, side walls and rear wall in conjunction with a rear face of said front wall include a storage area including partitioned walls running parallel to said side walls and spaced such that markers may be stored therewithin and a trackway running parallel to top edges of said rear wall and said front wall upon which a triangular shaped brace is supported extending upwardly and engaging a back surface of said playing surface for support.

7. A box configured to facilitate simultaneous playing of plural Bingo games comprising, in combination:

a knowdown playing surface formed from upper and lower playing surface portions which are pivotally interconnected, a brace removably attached to a rear portion of said playing surface to prop said surface up, and marker storage means both forward and aft said playing surface to allow ready access to markers including a vertical front wall barrier having a front face with a handle which nests within a complementally formed recess of said front face and a front wall portion including an arcuate and linear section complementally formed with said forward storage means to allow said forward storage means tonest thereagainst.

8. The case of claim 7 wherein two swinging doors are provided as said forward storage means.

9. The case of claim 8 wherein each said swinging door includes a dowel attached to a bottom wall of said box.

a top face of said swinging doors are provided with openings to allow storage therewithin, and a bottom wall face of said doors serve as an abutment for articles contained within the openings for storage in said doors.

10. The case of claim 9 wherein lid means are formed from said upper and lower said playing portions attached to said box by means of hinges and foldable one upon the other to provide a two-ply lid when in a stored configuration.

and magnetic latch means on said playing surface adapted to lie in registry with magnetic latch means contained on said box.

11. The case of claim 10 wherein a bottom wall, side walls and rear wall in conjunction with a rear face of said front wall define said box and include a storage area having partitioned walls running parallel to said side walls and spaced such that markers may be stored therewithin, and a trackway running parallel to top edges of said rear wall and a front wall upon which a triangular shaped brace is supported extending upwardly and engaging a back surface of said playing surface portions for support.

12. A device to facilitate the playing of plural games, comprising, in combination:

a case having an interior within which game playing implements are stored, said case including, a lid means for gaining access to said interior, means for increasing the surface area of said lid means to form an enlarged playing surface, and means for supporting said enlarged playing surface area above said case interior while allowing access to said interior to facilitate playing the plural games wherein said case includes a vertical front wall barrier having a front face having a handle which nests within a complementally formed recess of said front face and a front wall portion including an arcuate and linear section complementally formed with a swinging door to allow said swinging door to next thereagainst.

13. The case of claim 12 wherein two swinging doors are provided and said front wall portion has a second arcuate and linear wall portion to accommodate said second swinging door.

14. The case of claim 13 wherein each said swinging door includes a dowel attached to a bottom wall of said case, and each said door has an arcuate rear face and linear portion, a top face of each said door provided with openings to allow storage therewithin, and a bottom wall face of each said door to serve as an abutment for articles contained within the openings for storage in said doors.

15. The case of claim 14 wherein said lid means is formed from upper and lower playing portions attached to said case by means of hinges and foldable one upon the other to provide a two-ply lid when in a stored configuration, and magnetic latches on a playing surface upper portion adapted to lie in registry with magnetic latches contained on case interior surfaces.

16. The case of claim 15 wherein said case includes a bottom wall, side walls and rear wall in conjunction with a front wall defining a storage area including partitioned walls running parallel to said side walls and spaced such that markers may be stored therewithin and a trackway running parallel to top edges of said rear wall and said front wall upon which a triangular shaped brace is supported extending upwardly and engaging a back surface of said playing surface portions for support.

17. A box configured to facilitate simultaneous playing of plural Bingo games, comprising, in combination:

a knockdown playing surface formed from upper and lower playing surface portions which are pivotally interconnected and said upper surface forms an exterior box wall when stored, a brace removably attached to a rear portion of said playing surface to prop said surface up, and market storage means both forward and aft said playing surface to allow ready access to markers.

18. A device to facilitate the playing of plural games, comprising, in combination:

a case having an interior within which game playing implements are stored, said case including, a lid means for gaining access to said interior, means for increasing the surface area of said lid means to form an enlarged planar playing surface formed from upper and lower playing surfaces which are pivotally interconnected with said lower playing surface connected to said case remote from said pivotal interconnection, and means for supporting said enlarged playing surface area above said case interior while allowing access to said interior to facilitate playing plural games.

* * * * *